US005346446A

United States Patent [19]

Kaiser, II

[11] Patent Number: 5,346,446

[45] Date of Patent: Sep. 13, 1994

[54] JUMP ROPE HAVING SPRINKLING APPARATUS

[76] Inventor: Ronald R. Kaiser, II, 12060 Cavell, Livonia, Mich. 48150

[21] Appl. No.: 825,375

[22] Filed: Jan. 24, 1992

[51] Int. Cl.[5] ..... A63B 5/20

[52] U.S. Cl. ..... 482/82; 482/148; 472/13

[58] Field of Search ..... 472/13, 33, 128; 482/81, 82

[56] References Cited

U.S. PATENT DOCUMENTS

| | | | |
|---|---|---|---|
| 2,723,121 | 11/1955 | Cartwright | 482/82 |
| 2,921,743 | 1/1960 | Westover | 472/128 |
| 3,107,916 | 10/1963 | Cooper . | |
| 3,170,171 | 2/1965 | Mayhew et al. | 472/128 |
| 3,326,551 | 6/1967 | Clarke | 482/81 |
| 3,481,600 | 12/1969 | Lang, Sr. et al. . | |
| 4,315,623 | 2/1982 | Granderson | 482/81 |
| 4,736,945 | 4/1988 | Vinciguerra | 482/82 |
| 4,919,417 | 4/1990 | Poulas . | |
| 5,022,646 | 6/1991 | Kessler . | |
| 5,054,772 | 10/1991 | Winston | 482/82 |
| 5,230,678 | 7/1993 | Kaiser, II | 482/82 |
| 5,256,120 | 10/1993 | Howell | 482/82 |

OTHER PUBLICATIONS

Placard attached to device purchased by Applicant Feb. 4, 1992, Trendmasters, St. Louis, MO. ®1991 "Rainbow Skip-'N'-Fun Water Spraying Jump Rope".

*Primary Examiner*—Richard J. Apley
*Assistant Examiner*—Jerome Donnolly
*Attorney, Agent, or Firm*—Irving M. Weiner; Joseph P. Carrier; Pamela S. Burt

[57] ABSTRACT

An apparatus constructed to be used as a jump rope which includes a tube which sprays water upon a user jumping in a predetermined area. The apparatus includes a connection to a water source, a first handle including an on/off switch and a second handle. An auxiliary clip-on handle may be used for shortening the tube length to permit use by a single person.

11 Claims, 3 Drawing Sheets

JUMP ROPE HAVING SPRINKLING APPARATUS

BACKGROUND OF THE INVENTION

1. Field of the Invention

The present invention relates to a jump rope constructed of hose or tube material and connectable to a water source. More particularly, the present invention provides an entertaining and refreshing toy for children and adults. The toy provides a refreshing spray of water over the person in the jumping region of the toy. On hot days, such a device would be an enjoyable method for cooling off children and adults.

The apparatus of the present invention includes an on/off switch which also comprises a handle for turning the rope. A swivel is provided adjacent the handle to prevent twisting of the hose or tube material. A series of apertures are provided in the hose in the region of the hose where a person would most likely be when in the act of jumping. Such a region is defined as a "predetermined area". A handle is provided at the second end of the hose. The first end of the hose includes means for attaching the apparatus to a water source, preferably a garden hose.

2. Description of the Relevant Art

It has been known to provide water in a tube used for jumping rope. The water was added to taken from the tube to vary the weight for greater aerobic workouts. It has also been known to include light reflecting particles in water in a tube used for jumping for entertainment purposes.

U.S. Pat. No. 4,919,417 discloses an opening for adding or removing water to adjust the weight of the jump rope apparatus.

U.S. Pat. No. 5,022,646 discloses a water filled tube including light reflecting particles used as a jump rope apparatus.

It has also been known to provide small apertures in hoses to permit the slow release of water to plants. These hoses are known in the gardening field as "soaker" hoses.

The present invention provides a jump rope including a refreshing spray.

SUMMARY OF THE INVENTION

The present invention may suitably comprise, consist of or consist essentially of a water supply means, a first handle, a swivel means, a jump rope portion including apertures therein and a second handle. The first handle may comprise an on/off apparatus for controlling the flow of water through the jump rope. Preferably, at least one impact protector is provided on the jump rope portion of the apparatus. A hook or similar fastening device may be associated with the second handle for permitting securement of the apparatus at one end to a fixed structure. An auxiliary handle including a clamping member may additionally be provided to shorten the length of the jump rope portion to permit use of the apparatus by one person.

It is an object of the present invention to provide a water filled jump rope including a spray of water onto the person in the "jump" area.

It is a further object of the present invention to provide a tangle free hose.

It is a further object of the present invention to provide an on/off control of the water spray.

It is a further object of the present invention to provide an apparatus of a length for use by one to three individuals.

The above and further objects, details, and advantages of the invention will become apparent from the following detailed description, when read in conjunction with the accompanying drawings.

DETAILED DESCRIPTION OF THE PREFERRED EMBODIMENT

Figure 1:
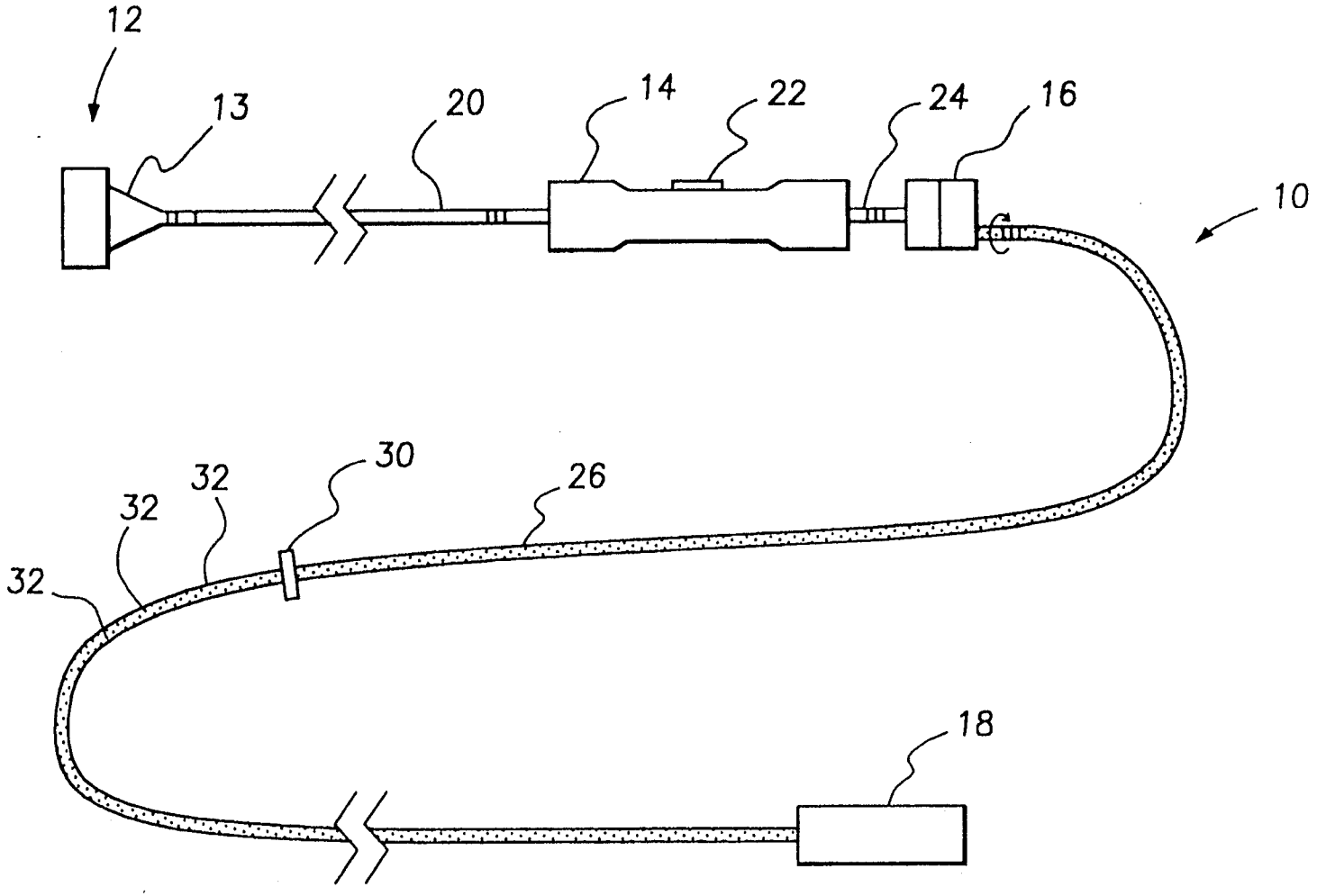
FIG. 1 illustrates a jump rope apparatus in accordance with the present invention.

Referring now to the drawings, and more particularly to FIG. 1 thereof, an apparatus 10 in accordance with the present invention is shown. The apparatus 10 includes a water supply means 12, a first handle 14, swivel means 16 and a second handle 18, each connected by a length of hose or tubing. The length of hose or tubing is preferably separated into distinct portions as set forth below.

The water supply means 12 is preferably provided at a first end with a female threaded connection to facilitate connection to a water source such as a common lawn and garden water hose (not shown) for providing a flow of water through the hoses of the apparatus 10. Other types of connections to the water source are possible. The water supply means 12 may include a tapered portion 13 for reducing the size of the water supply hose to a desired size and includes secured thereto a length of tubing 20.

Figure 2:
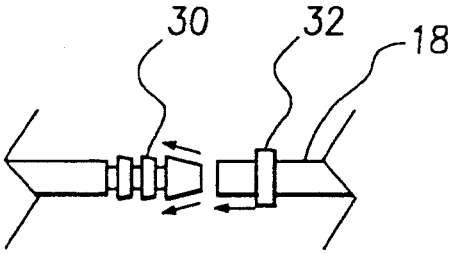
FIG. 2 illustrates a hose connection between the hose or tube and a plastic member of the apparatus.
Figure 3:
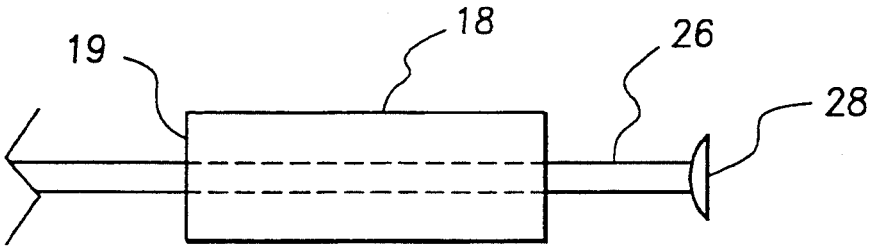
FIG. 3 illustrates the hose end second handle construction.

The first tubing 20 is preferably secured using a friction fitting best seen in FIG. 2. The first tubing 20 is pressed onto and over expansion members 30 which are trapezoid shaped and utilizes the tubing's resiliency to secure it to the fitting. A clamp 32 may be included over the tubing and expansion members 30 to ensure a water tight and permanent attachment since the tubing may lose some resiliency over time and due to temperature extremes. The clamp 32 may be a spring-type clamp or a simple band sized to fit about the tubing and fitting. Preferably, all connections referred to in regard to the present apparatus 10 are of this type.

The first tubing 20 is connected to a first handle 14 at the handle 14 first end. Preferably, a means for controlling the water flow 22 is included on handle 14. Means 22 comprises an on/off switch and related internal components for permitting or blocking the flow of water through the handle 14 at a water exit. As shown the on/off switch is disposed at a position on said first handle 14 at which the switch can be easily manipulated by the hand of a user while the hand is gripping the first handle. Handle 14 is shaped to facilitate grasping the handle 14 even under wet conditions and may optionally include texture thereon to enhance friction. The handle 14 may further include grooves or indentations to enhance the ability to hold the handle in a user's hand.

Handle 14 includes a fitting at its second end for the attachment of a short section of second tubing 24 connecting the handle 14 with a swivel means 16. As discussed above, the fittings are of the type previously disclosed.

Swivel means 16 is provided to prevent twisting of the jump rope hose portion 26 which is connected to the swivel means 16 opposite the handle 14 connection. Swivel means 16 must freely turn in relation to the turning of the jump rope hose portion 26.

Figure 4:
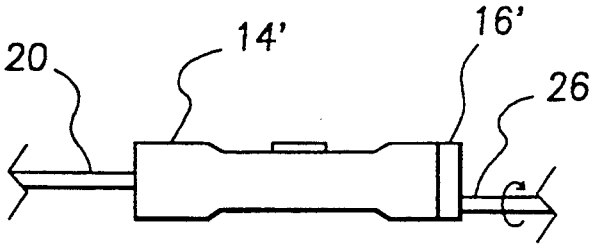
FIG. 4 illustrates a second embodiment of the first handle including a swivel portion.

As seen in FIG. 4, a handle 14' may include the swivel means 16' as an integral part thereof. The swivel means 16' in this embodiment, would be pivotally attached to the handle 14' to prevent twisting of the tubing 26. The swivel means 16, 16' are coextensive with the handles 14, 14', respectively.

It should be noted that first tubing 20 between water supply means 12 and first handle 14 is of such a length to permit the means 12 to rest on the ground when the handle 14 is of such a length to permit the means 12 to rest on the ground when the handle 14 is held by a user. This feature eliminates the weight of the water source garden hose from the handle 14 permitting the user comfortable manipulation of the apparatus 10.

Jump rope hose portion 26 extends from swivel 16 or 16' to an end having associated therewith a second handle 18. An end closure 28 is provided for hose portion 26 having a large end portion and a portion fitted within the tubing 26. An aperture in the handle 18 at end 19 permits the hose to pass therethrough but not the large end portion on the closure 28 thus securing the handle to the apparatus 10.

Preferably, hose portion 26 includes associated therewith at least one impact protector 30 to prevent the hose portion from contacting the ground surface during use of the apparatus 10 thus preventing unwanted wear and abuse to the hose portion 26. A predetermined area of hose portion 26 includes a series of apertures for releasing water upon the person "jumping rope" in this predetermined area. Thus, the predetermined area may be defined as the section of hose portion 26 which spins around a user of the apparatus.

The apertures 32 preferably are sized to provide a spray or mist of water in the predetermined area. However, a variety of aperture patterns and aperture sizes may be provided resulting in a variety of patterns for sprays. Preferably, the apertures 32 are 1/32 inch or 1/64 inch in diameter spaced at 6 inch intervals. The apertures 32 may be alternated at 90° to the previous apertures. The apertures 32 are formed by pressing a drill bit or similar device through the entire tube 26. A maximum number of apertures 32 will be reached before loss of water pressure prevents spray from being released towards the end of the tubing 26 adjacent second handle 18.

Figure 5:
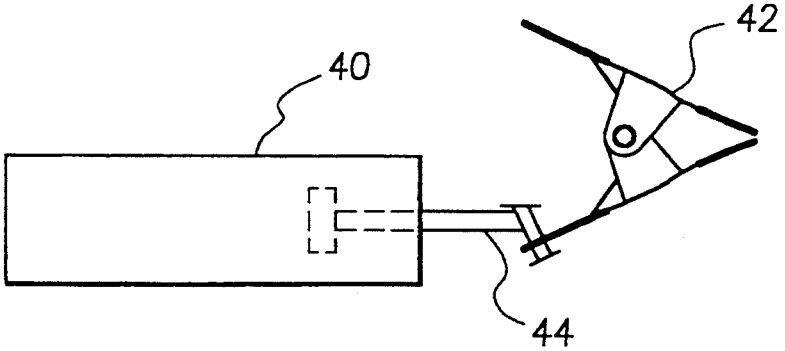
FIG. 5 illustrates an auxiliary handle.

As seen in FIG. 5, an auxiliary handle 40 may be provided to shorten the length of hose portion 26 for use of the apparatus 10 by a single person. The auxiliary handle 40 includes a clamp 42 which attaches the handle 40 to hose portion 26 without pinching off the water flow through the tubing. Handle 40 freely turns on support member 44 which attaches the handle 40 to clamp 42 in a manner similar to that described with respect to second handle 18.

Second handle 18 may optionally include a means for securing the hose portion 26 to stationary objects such as a fence or post (not shown).

In use, the apparatus 10 would be attached to a water source such as a garden hose. A first person would retain first handle 14, a second person would retain second handle 18 and a third person would stand adjacent the predetermined area. Either before the start of "jumping rope" or after the start of "jumping rope", the first person may turn on the water with means 22. The water then sprays upon the person in the jumping region "jumping rope" with hose portion 26.

If only two people are present, a first person may retain first handle 14 with the second handle secured to a stationary object such as a fence or post.

If a single person desires to utilize apparatus 10, auxiliary handle 40 may be attached to hose portion 26 between first handle 14 and the predetermined area. The user then retains handle 40 and handle 18 for turning hose portion 26 for use as a "jumping rope" as is well known. The water may be turned on before the user starts turning hose portion 26.

Figures 6, 6A:
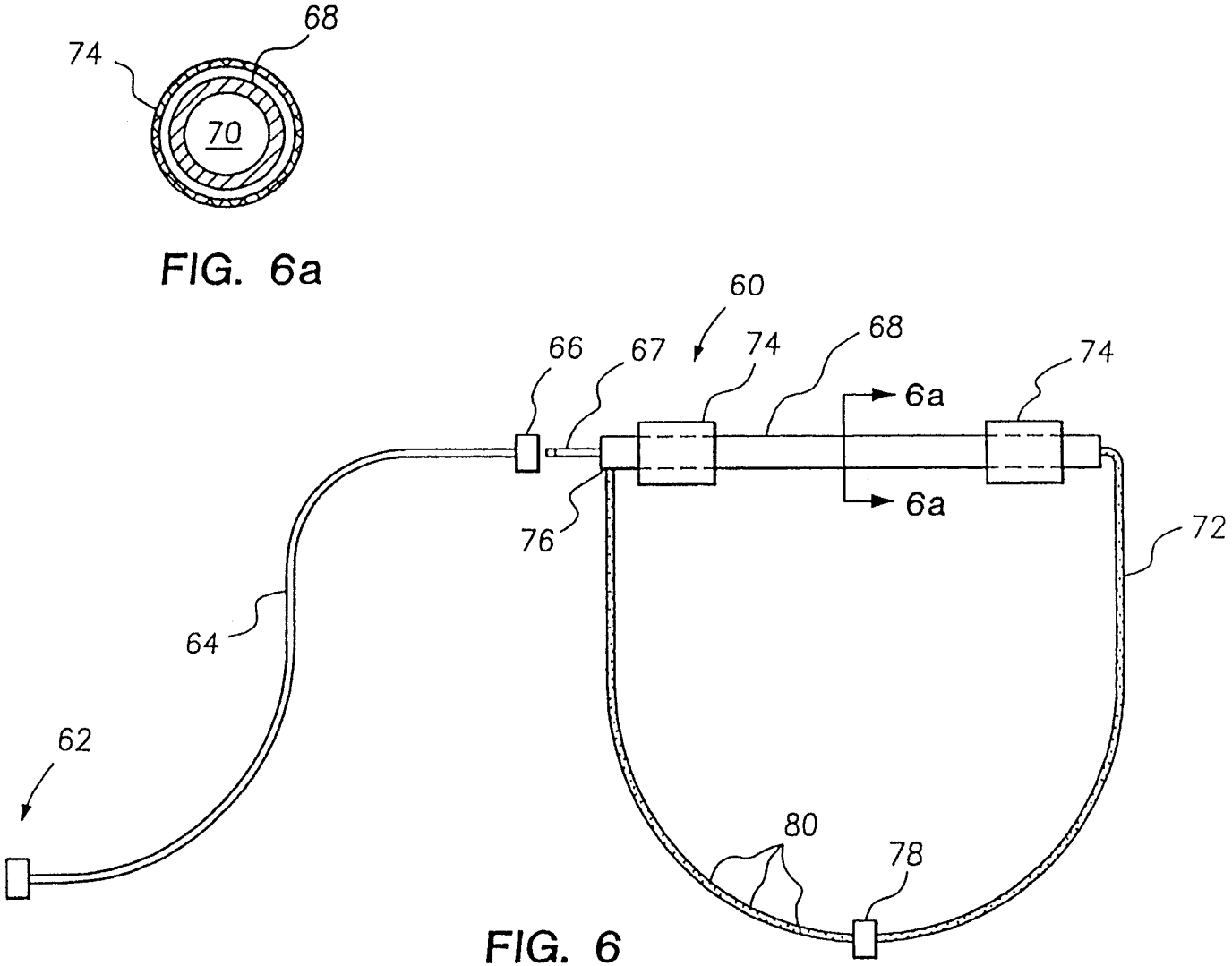
FIGS. 6 and 6A illustrate a second embodiment of the present invention specifically designed for use by a single person.

As best seen in FIG. 6, a second embodiment of a toy in accordance with the present invention is shown. The apparatus 60 is specifically designed for a single user wherein the apparatus 10 shown in FIG. 1 is capable of being used by one, two or three users.

Apparatus 60 includes a water supply means 62 comprising a threaded female connection for connection to a hose (not shown) as discussed above. Again, other types of connections are known and may be employed for connecting to a water source. A water supply tube 64 connects the water supply means to a swivel connection 66 which also includes a release mechanism to permit the apparatus to be used without the water supply means 62 and tube 64. The length of tube 64 is sufficient to permit use of the apparatus 10 without the weight of the water source on the apparatus 10 impeding the user, a preferred length is 6 feet.

The jumping portion of the apparatus 60 comprises a rod 68 having a central passageway 70 its entire length. A mating release mechanism 67 is provided at one end of rod 68 for connection to swivel connection 66. Mechanism 67 permits water to flow through the passageway to a jump rope hose portion 72 which is secured to the rod 68 at the second end which is the end of the rod opposite mechanism 67. Additionally provided on the rod 68 are a pair of handles 74 which freely turn upon and slide along rod 68 (note FIG. 6A).

The handles 74 adjust to the width of the armspan of the user by sliding along rod 68. The jump rope hose portion 72 is similar in construction to hose portion 26 discussed above with portion 72 having a plurality of apertures 80 therein for providing a spray of water in a predetermined area. Again, the predetermined area comprises the area most likely to be occupied by a person "jumping rope" over the hose portion 72. The hose portion 72 is closed and secured to the rod at its second end 76. An impact protector 78 is preferably provided on the hose portion 72 to prevent wear and tear on the hose.

The hose portion 72 may be a single piece extending from mechanism 67 through passageway 70 and exiting rod 68 to then comprise the jump rope hose portion. This construction would eliminate the need for multiple connections and leaks.

Although there has been described what is at present considered to be preferred embodiments of the invention, it will be understood that various modifications and variations may be made therein, and it is intended to cover in the appended claims all such modifications as fall within the true spirit and scope of the invention.

I claim:

1. An apparatus for use as a jump rope comprising:

water supply means for providing a flow of water;

a first handle operatively connected to said water supply means at a first end of the first handle and having a water exit at a second end of the first handle;

said water exit being operatively connected to a swivel means for preventing twisting of a jump rope hose portion, said jump rope hose portion being flexible and operatively connected at a first end thereof to said swivel means, and said swivel means being coextensive with said first handle;

said jump rope hose portion including a series of apertures for the release of water in a predetermined area of the hose portion;

a sealing member for sealing a second end of said jump rope hose portion; and a second handle adjacent said second end of said jump rope hose portion;

said water supply means comprising a tube connectable at a first end thereof to a water source and permanently connected to said first handle at a second end of the tube;

said tube being of such a length that a portion of the tube remains on the ground when the first handle is held by a user; and said first handle includes actuating means positioned in said first handle so as to allow the user to actuate said actuating means while gripping said handle during use.

2. The apparatus of claim 1, wherein:

said first end of said tube includes a threaded connection for selective attachment to a garden hose.

3. The apparatus of claim 1, wherein:

said series of apertures are provided in a size to provide a mist of water in said predetermined area.

4. The apparatus of claim 1, wherein:

said second handle is slidably retained on said jump rope hose portion by a hose plug member.

5. The apparatus of claim 1, including an auxiliary handle provided with clamping means so as to allow said auxiliary handle to be selectively clamped along said jump rope hose portion to shorten an operative length of the hose portion.

6. A jump rope apparatus adapted to convey water under pressure, comprising:

water supply means for connection to a water source at a first end thereof and to a first handle at a second end thereof;

said first handle being shaped to facilitate grasping and having adjacent thereto a swivel means for preventing twisting of a jump rope hose portion;

said jump rope hose portion comprising a hose of sufficient length with a series of apertures defined in a predetermined area of the hose portion, a second handle at a distal end of said hose portion and a closure for said distal end of said hose portion;

said predetermined area defined by the second of the hose portion which would spin around a user of said apparatus;

said first handle including means for controlling flow of water to said hose portion, said flow controlling means including a switch member disposed on said first handle at a position where the switch member can be easily manipulated by a hand of the user while the hand is gripping said first handle; and said swivel means being coextensive with said first handle.

7. The apparatus of claim 6, wherein:

said series of apertures sized to provide a mist of spray of water from said hose.

8. The apparatus of claim 7, wherein:

said predetermined area includes at least one impact protector around said hose.

9. The apparatus of claim 8, wherein:

said apparatus further includes an auxiliary handle selectively clampable upon said jump rope hose portion to shorten an operative length of said portion to permit a single individual use of said apparatus, said auxiliary handle having a clamp which securely grasps said portion without stopping the flow of water.

10. An apparatus for use as a jumping rope, comprising:

water supply means for providing a flow of water comprising a tube connectable at a first end thereof to a water source and permanently connected to a first handle at a second end of the tube;

said first handle being connected to said tube at a first end of the first handle and having a water exit at a second end of the first handle;

said water exit being operatively connected to a swivel means for preventing twisting of a jump rope hose portion, said jump rope hose portion being operatively connected at a first end to said swivel means, and said swivel means being coextensive with said first handle;

said jump rope hose portion including a series of apertures for the release of water in a predetermined area of the jump rope hose portion;

a sealing member for sealing a second end of said jump rope hose portion;

a second handle adjacent said second end of said jump rope hose portion; and an auxiliary handle provided with clamping means so as to allow said auxiliary handle to be selectively clamped along said jump rope hose portion to shorten an operative length of the jump rope hose portion.

11. A jump rope apparatus according to claim 6, wherein said water supply means comprises a tube having a threaded connection at a first end thereof for being connected to a water source and being permanently connected to said first handle at a second end thereof, said tube being of such a length that a portion thereof remains on the ground when said first handle is held by a user.

* * * * *